US006093055A

United States Patent [19]

Sakano

[11] Patent Number: 6,093,055

[45] Date of Patent: Jul. 25, 2000

[54] FLAT FLEXIBLE CABLE CONNECTOR

[75] Inventor: Masahiro Sakano, Ebina, Japan

[73] Assignee: Molex Incorporated, Lisle, Ill.

[21] Appl. No.: 09/114,550

[22] Filed: Jul. 13, 1998

[30] Foreign Application Priority Data

Jul. 18, 1997 [JP] Japan ..... 9-209892

[51] Int. Cl.[7] ..... H01R 9/07

[52] U.S. Cl. ..... 439/495

[58] Field of Search ..... 439/352, 354, 439/325–328, 67, 77, 492–498

[56] References Cited

U.S. PATENT DOCUMENTS

| | | | |
|---|---|---|---|
| 4,969,840 | 11/1990 | Ii et al. | 439/352 |
| 5,397,247 | 3/1995 | Aoki et al. | 439/495 |
| 5,492,486 | 2/1996 | Tanigawa | 439/495 |
| 5,501,610 | 3/1996 | Ikemoto | 439/498 |
| 5,562,487 | 10/1996 | Ii et al. | 439/495 |
| 5,580,272 | 12/1996 | Yamaguchi et al. | 439/495 |
| 5,688,143 | 11/1997 | McHugh et al. | 439/495 |
| 5,906,504 | 5/1999 | Igarashi et al. | 439/495 |

*Primary Examiner*—Hien Vu

*Attorney, Agent, or Firm*—Stacey E. Caldwell

[57] ABSTRACT

An improved flat flexible cable connector (1) for a flat flexible cable (6) includes a housing (4), terminals (3) and an actuator (5) movable between an initial engagement position and a final engagement position. The terminals include integral contact pieces (16) that are deflected by a pushing piece (8) of the actuator during movement of the actuator to its final engagement position. When the actuator is in the final engagement position, the cable is held in position by way of projections (21) on the housing which engage and retain corresponding engagement holes (20) of the cable, and, at the same time, the pushing piece of the actuator presses conductors of the cable against contact areas of the contact pieces (16) of the terminals. Movement of the actuator to its initial position puts the cable (6) in a releasable position by moving the actuator away from the contact pieces of the terminals and from the projections of the housing, thereby causing the contact pieces to lift the cable and release the projections from the engagement holes of the cable. Thus the cable can be pulled out from the cable connector when the actuator is in this initial position. The cable is positively held in the final engagement position and cannot be inadvertently released. The cable is therefore put in a releasable position by a single action.

4 Claims, 4 Drawing Sheets

FLAT FLEXIBLE CABLE CONNECTOR

FIELD OF THE INVENTION

The present invention relates to a flat flexible cable connector for making an electric connection between a flat flexible cable (including an FPC, an FFC or any other flat flexible cable) and electrical terminals of the connector.

BACKGROUND OF THE INVENTION

A flat flexible cable connector (or "FFC" connector) for making an electric connection between a flat flexible cable and the electrical terminals of the connector typically comprises a housing, terminals inserted into one side of the housing, and an actuator slidably attached to the housing. The actuator is permitted to move between an initial engagement position and a final engagement position, in which final engagement position the conductors of the FFC are pushed against contact areas of the terminals, and at the same time, the flat flexible cable is positively held by engagement portions of the actuator.

Known flat flexible cable connectors utilize engagement projections formed on the actuator to hold the cable in position by engaging corresponding engagement holes of the cable. In releasing the flat flexible cable from the connector, first the actuator must be moved from its final engagement position to its initial engagement position, and the engagement projections of the actuator must be moved out of engagement with the engagement holes of the cable. Thus, two separate and distinct actions are required to release the cable. Furthermore, if an undesired or inadvertent force is applied to the cable or the actuator which moves it to its initial engagement position, the cable is, consequently, also inadvertently released from the connector.

SUMMARY OF THE INVENTION

One object of the present invention is to provide a flat flexible cable connector capable of positively holding a flat flexible cable in position, while also facilitating the release of the cable from the connector when desired.

To attain this object, a flat flexible cable connector according to the present invention is so constructed that engagement holes of a flat flexible cable are held by engagement projections of the housing when the actuator is shifted to its final engagement position.

Specifically, a flat flexible cable connector for making an electric connection between a flat flexible cable and electrical terminals of the connector, wherein said flat flexible cable includes conductors embedded therein and engagement holes adjacent the conductors, comprises a housing having a rear side permitting insertion of the terminals and an actuator slidably attached to a front side of the housing. Each terminal includes a contact piece with a contact area for making contact with the electrical terminals. The actuator is movable between an initial engagement position and a final engagement position, and includes a cable slot and a pushing piece which biases the cable against the contact area of the terminals. The housing further includes engagement projections which extend into and engage corresponding engagement holes of the flat flexible cable, and movement of the actuator to its final engagement position retains the conductors of the cable between the pushing piece and the contact areas of the terminals, keeping the FFC conductors in contact with the contact area of the terminals and, at the same time, allowing the pushing piece of the actuator to keep the engagement holes of the cable in engagement with the engagement projections of the housing.

The shifting of the actuator from its final engagement position to its initial engagement position will cause the contact pieces of the terminals to lift the end of the flat flexible cable until the engagement holes of the cable are released from the engagement projections of the housing. If an undesired pulling force is applied to the flat flexible cable, the engagement holes of the cable remain engaged with the engagement projections of the housing and therefore transmission of the pulling force to the actuator is prevented. This therefore prevents undesired movement of the actuator to initial engagement position.

Other objects and advantages of the present invention will be understood from the following description of a flat flexible cable connector according to a preferred embodiment of the present invention in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DESCRIPTION OF THE PREFERRED EMBODIMENT

Figure 1:
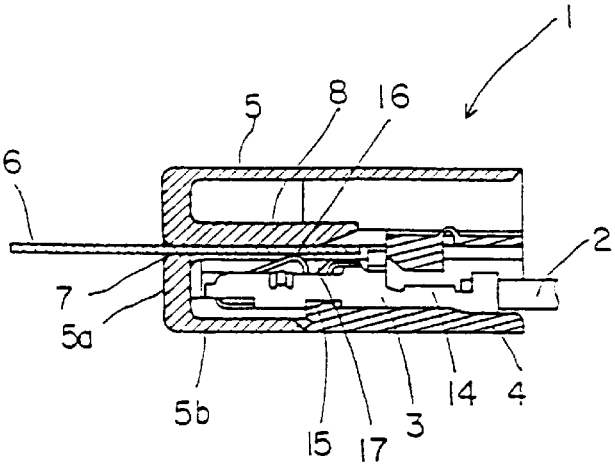
FIG. 1 is a longitudinal section of a flat flexible cable connector according to the invention taken along line A—A in FIG. 4, showing the connector in its final engagement position such that the contact area of the terminal of the connector is in contact with the overlying cable end.
Figure 2:
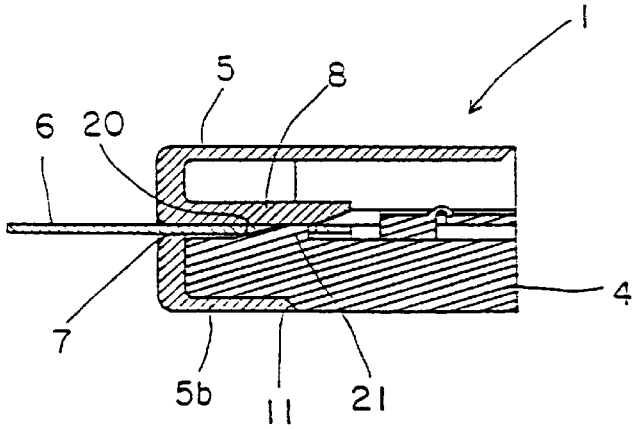
FIG. 2 is a similar longitudinal section of the flat flexible cable connector taken along line B—B in FIG. 4, showing the connector in its final engagement position, such that an engagement projection of the connector housing extends into a corresponding engagement hole of the cable.
Figure 3:
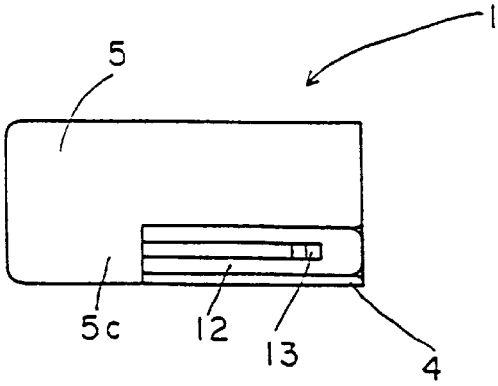
FIG. 3 is a side view of the flat flexible cable connector in its final engagement position.
Figure 4:
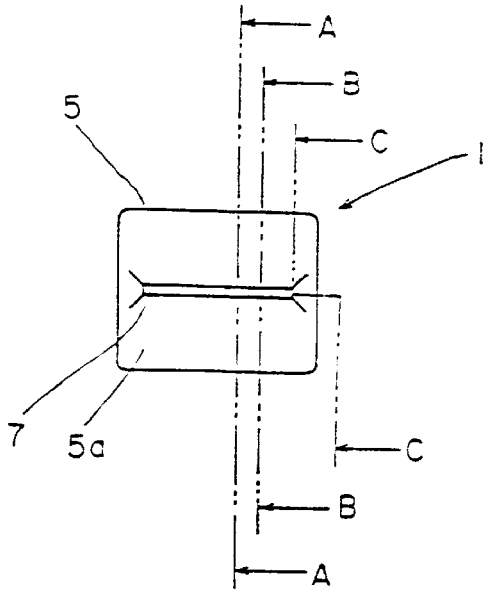
FIG. 4 is a front view of the flat flexible cable connector.
Figure 5:
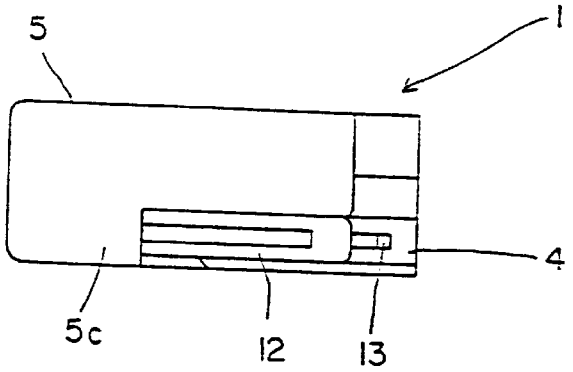
FIG. 5 is a side view of the flat flexible cable connector in its initial engagement position.
Figure 6:
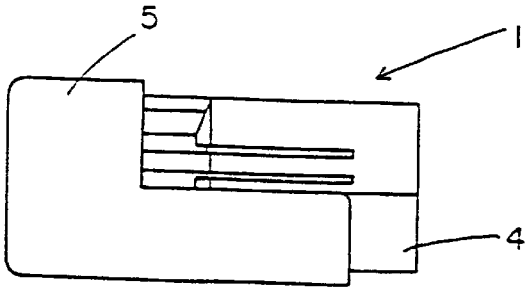
FIG. 6 is a plan view of the flat flexible cable connector in its initial engagement position.

FIGS. 1 to 3 show a flat flexible cable connector according to one embodiment of the present invention in a final engagement position. FIGS. 4 to 9 show the connector in its initial engagement position, as explained in more detail hereinafter.

Figure 7:
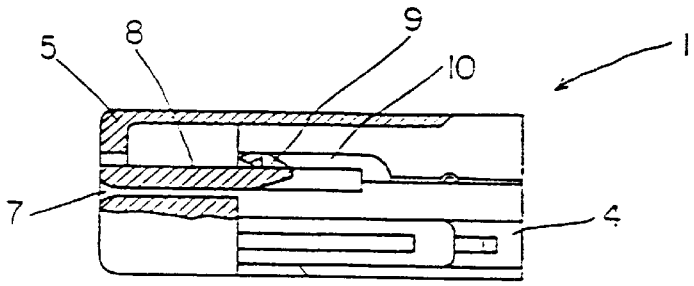
FIG. 7 is a longitudinal section of the flat flexible cable connector taken along the line C—C in FIG. 4, showing the connector in its initial engagement position.
Figure 10:
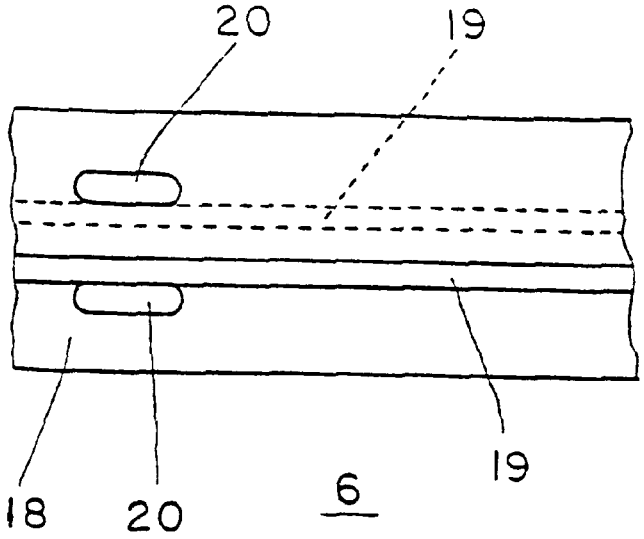
FIG. 10 is a plan view of the end of a flat flexible cable.

Flat flexible cable connector 1 is used for making an electric connection between a flat flexible cable 6 and electrical terminals 3. As seen in FIG. 10, flat flexible cable 6 has two parallel conductors 19 embedded in either side of the cable, and elongated engagement holes 20 are formed adjacent the conductors 19 proximate the end of the cable. The connector comprises a housing 4 mounting a plurality of terminals including a rear side which permits insertion of terminals 3, at least one terminal 3 which includes a cantilevered contact piece 16 integrally connected thereto, and an actuator 5 slidably attached to a front side of the housing 4. The actuator 5 is slidably movable between an initial engagement position and a final engagement position. The actuator 5 has a cable slot 7 formed therethrough on a front wall 5*a* and a rearwardly extending pushing piece 8 formed inside to push conductors 19 against corresponding contact areas of contact pieces 16 of terminals 3. The cable is inserted into cable slot 7 and extends along the lower surface of pushing piece 8 wherein conductors 19 are held between pushing piece 8 and contact pieces 16 of terminals 3. As seen in FIG. 7, a projection 9, formed on one side of pushing piece 8, is caught by a corresponding lock piece 10 formed on housing 4 in the initial engagement position, thereby preventing inadvertent removal of actuator 5 from housing 4. As seen in FIGS. 1 and 2, a bottom wall 5*b* of actuator 5 abuts against a step-like transition 11 of a bottom wall of housing 4 and, as seen in FIG. 3, a lock piece 12 of a side wall 5*c* of actuator 5 is caught by a projection 13 formed on the side wall of housing 4 when in the final engagement position.

As best seen in FIG. 1, an electric wire 2 is terminated with a terminal 3 by crimping a crimp section 14 of the terminal to the end of the electric wire 2, and terminal 3 is then mounted within housing 4 by inserting the terminal from the rear side of the housing until it is caught by a lance 15 formed on the inside of the housing 4. Note that terminal 3 can, alternatively, be terminated to a printed circuit board or the like. The contact piece 16 of terminal 3 is located opposite overlying pushing piece 8, thereby pressing the cable end overlying pushing piece 8 and contact piece 16 when actuator 5 is in the final engagement position (see FIG. 1), and likewise, lifting the cable end above pushing piece 8 when actuator 5 is shifted to the initial engagement position (see FIG. 8).

As seen in FIG. 2, housing 4 includes ramp-like engagement projections 21 formed on an inside thereof to engage and retain corresponding elongated engagement holes 20 of cable 6 when actuator 5 is in its final engagement position. It should be noted that FIGS. 1, 2, 8 and 9 show terminal 3 in contact with conductor 19 on the underside of cable 6 (phantom lines in FIG. 10) and engagement projection 21 engages the hole adjacent conductor 19 on the underside of cable 6; and that similar terminals and engagement projections may be positioned in the same relation to conductor 19 on the other side of cable 6 (solid lines in FIG. 10). Specifically, pushing piece 8 of the actuator 5 may be located on the underside of cable 6, and the contact piece 16 of an adjacent terminal 3 and an adjacent engagement projection 21 of the housing may be located on the upper side of cable 6. Depending on the configuration of the conductors within the cable the terminals and engagement projections may be located on either or both sides of the cable.

Figure 8:
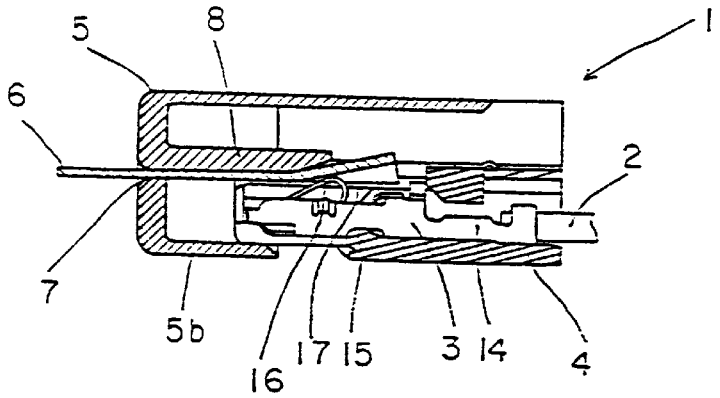
FIG. 8 is a longitudinal section of the flat flexible cable connector taken along the line A—A in FIG. 4, showing the connector in its initial engagement position, such that the contact piece of the terminal of the connector lifts the end of the overlying cable.
Figure 9:
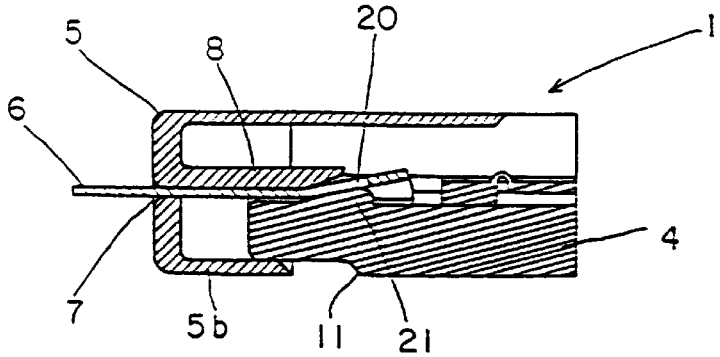
FIG. 9 is a similar longitudinal section of the flat flexible cable connector taken along the line B—B in FIG. 4, showing the connector in its initial engagement position, such that the cable end is raised sufficiently to release the engagement holes of the cable end from the corresponding engagement projections.

In connecting the flat flexible cable 6 to the cable connector 1, and with actuator 5 in the initial engagement position, the end of the cable is inserted into cable slot 7 of the actuator and moved forward into an inlet section 17 of housing 4, where contact pieces 16 are positioned in the pathway of the cable. The end of the cable is lifted over the contact pieces while its conductors 19 are kept in engagement with contact areas, and, at the same time, engagement holes 20 of the cable end are positioned adjacent engagement projections 21 without being engaged, as shown in FIGS. 8 and 9. Next, actuator 5 is moved to its final engagement position whereat the cable end is pushed against the contact pieces 16, thereby deflecting contact pieces 16 and effecting electrical contact with the overlying conductors 19 of the cable and, at the same time, causing projections 21 to engage the corresponding engagement holes 20 of the cable end, as seen in FIGS. 1 and 2. In this position, actuator 5 cannot be moved to its initial engagement position even if an undesired pull is given to cable 6 since projections 21 retain cable 6.

To disconnect cable 6 from the connector, actuator 5 is moved to the initial engagement position, as shown in FIGS. 8 and 9, whereat pushing pieces 8 move away from contact pieces 16 of terminals 3 and cause the release of projections 21 from engagement holes 20 of the cable. Thus, cable 6 can be removed from the cable connector.

As may be understood from the above, a flat flexible cable connector according to the present invention is designed to permit its actuator to be moved between a final engagement position and an initial engagement position. When the actuator is moved to the final engagement position, the cable connector positively retains the cable by way of the projections of the housing which engage corresponding engagement holes of the cable end while the pushing pieces of the actuator push the conductors of the cable end against the contact areas of the terminals. When the actuator is moved to its initial engagement position, the cable connector releases the cable by moving the pushing pieces away from both the contact pieces of the terminals and the projections of the housing, thereby permitting the cantilever-like contact pieces to lift the cable end and release the projections from the engagement holes of the cable. Thus, the cable can be removed from the cable connector. Therefore, the cable is positively held in its final engagement position, and the positively held cable can be put in a releasable position by a simple, single action.

What is claimed is:

1. A flat flexible cable connector (1) for a flat flexible cable (6), said flat flexible cable having conductors (19) contained therein and engagement holes (20) formed adjacent the conductors (19), the connector comprising:

a housing (4) including a bottom portion and engagement projections (21) formed integrally from the bottom portion, wherein the engagement projections are immovable relative to the bottom portion of the housing and are adapted to engage the engagement holes (20) of the cable;

a plurality of terminals (3) mounted in the housing, each terminal including an integral cantilevered contact piece (16) having contact areas adapted to make electrical contact with the conductors (19); and a hollow actuator (5) having a top bottom and sidewalls slidably received on the housing and movable between an initial engagement position and a final engagement position, the actuator including an elongated pushing piece (8) positioned between said top and bottom walls which causes deflection of the cantilevered contact piece when the actuator is moved to the final engagement position; and wherein, when the cable (6) is inserted into the connector and the actuator (5) is moved to the final engagement position, the pushing piece (8) is moved toward and over the contact pieces to press the conductors of the cable into electrical contact with contact areas of the contact pieces of the terminals and causes the engagement projections (21) to engage the engagement holes (20) of the cable, and when the actuator (5) is moved to the initial engagement position, the pushing piece (8) is moved away from the contact pieces (16) which moves the conductors out of engagement with the contact pieces and causes the contact pieces to simultaneously lift the cable, and the engagement holes formed therein, out of engagement with the engagement projections (21).

2. A flat flexible cable connector according to claim 1 wherein the terminals are inserted into the housing through a rear wall thereof and the actuator is slidably mounted on a front wall of the housing.

3. A flat flexible cable connector according to claim 1 wherein the housing (4) and actuator (5) have initial complementary interengaging lock means (9,10) for holding the housing and actuator in the initial engagement position and final complementary interengaging lock means (12,13) for holding the housing and actuator in the final engagement position.

4. A flat flexible cable connector according to claim 1 wherein the actuator further includes a cable slot (7) on a front wall **(5*a*)** of the actuator.

* * * * *